US009777347B2

(12) United States Patent
Moxson et al.

(10) Patent No.: US 9,777,347 B2
(45) **Date of Patent: *Oct. 3, 2017**

(54) MANUFACTURE OF NEAR-NET SHAPE TITANIUM ALLOY ARTICLES FROM METAL POWDERS BY SINTERING WITH PRESENCE OF ATOMIC HYDROGEN

(71) Applicant: ADVANCE MATERIAL PRODUCTS, INC., Hudson, OH (US)

(72) Inventors: Vladimir S. Moxson, Hudson, OH (US); Mykhailo Matviychuk, Parma, OH (US); Vladimir Duz, Hudson, OH (US)

( * ) Notice: Subject to any disclaimer, the term of this patent is extended or adjusted under 35 U.S.C. 154(b) by 122 days.

This patent is subject to a terminal disclaimer.

(21) Appl. No.: 14/739,031

(22) Filed: Jun. 15, 2015

(65) Prior Publication Data

US 2015/0328684 A1 Nov. 19, 2015

Related U.S. Application Data

(63) Continuation-in-part of application No. 14/584,176, filed on Dec. 29, 2014, which is a continuation of (Continued)

(51) Int. Cl.
*C22C 1/04* (2006.01)
*B22F 1/00* (2006.01)

(Continued)

(52) U.S. Cl.
CPC ..... *C22C 1/0458* (2013.01); *B22F 1/0003* (2013.01); *B22F 3/15* (2013.01);

(Continued)

(58) Field of Classification Search
CPC ..... C22C 1/0458; B22F 1/0003

(Continued)

(56) References Cited

U.S. PATENT DOCUMENTS 8,920,712 B2 * 12/2014 Ivasishin ..... B22F 1/0003 419/31
2003/0211001 A1 11/2003 Ivasishin et al.

(Continued)

FOREIGN PATENT DOCUMENTS

DE 19921934 A1 11/2000

OTHER PUBLICATIONS

International Search Report and Written Opinion dated Mar. 30, 2016.

(Continued)

*Primary Examiner* — Weiping Zhu

(57) ABSTRACT

Disclosed herein is a process that includes:

(a) providing a powder blend comprising (1) one or more hydrogenated titanium powders containing around 0.2 to around 3.4 weight % of hydrogen, and (2) one or more master alloys, comprising Al, V, or a combination thereof, (b) consolidating the powder blend by compacting the powder blend to provide a green compact, (c) heating the green compact to a temperature ranging from around 400° C. to around 900° C., thereby releasing the majority or all of the hydrogen from the hydrogenated titanium, and partially sintering the green compact without fully sintering it, to obtain a partially sintered article having a density of about 60% to about 85% of theoretical density, (d) sizing the partially sintered article at a temperature at or around room temperature to obtain an sized article having a density of about 80% to about 95% of theoretical density, (Continued)

(e) heating the sized article in vacuum thereby sintering the article to form a sintered dense compact having a density of 99% of theoretical density or higher.

14 Claims, 4 Drawing Sheets

Related U.S. Application Data application No. 13/205,527, filed on Aug. 8, 2011, now Pat. No. 8,920,712, which is a continuation-in-part of application No. 11/811,578, filed on Jun. 11, 2007, now Pat. No. 7,993,577.

(51) Int. Cl.

| | |
|---|---|
| ***B22F 3/16*** | (2006.01) |
| ***B22F 3/15*** | (2006.01) |
| ***B22F 3/17*** | (2006.01) |
| ***B22F 3/20*** | (2006.01) |
| ***B22F 3/18*** | (2006.01) |
| ***C22C 14/00*** | (2006.01) |

(52) U.S. Cl.
CPC ..... *B22F 3/162* (2013.01); *B22F 3/17* (2013.01); *B22F 3/18* (2013.01); *B22F 3/20* (2013.01); *C22C 14/00* (2013.01); *B22F 2998/10* (2013.01)

(58) Field of Classification Search
USPC ..... 75/245
See application file for complete search history.

(56) References Cited

U.S. PATENT DOCUMENTS

| | | | |
|---|---|---|---|
| 2009/0252638 | A1 | 10/2009 | Duz et al. |
| 2012/0058002 | A1 | 3/2012 | Ivasishin et al. |

OTHER PUBLICATIONS

International Search Report and Written Opinion dated Sep. 29, 2016.

* cited by examiner

MANUFACTURE OF NEAR-NET SHAPE TITANIUM ALLOY ARTICLES FROM METAL POWDERS BY SINTERING WITH PRESENCE OF ATOMIC HYDROGEN

This application is a continuation-in-part of U.S. Ser. No. 14/584,176, which is a continuation of U.S. Ser. No. 11/811,578, which is a continuation-in-part of U.S. Ser. No. 11/811,578, filed Jun. 11, 2007, the entire contents of which are incorporated herein by reference.

BACKGROUND

Field

Disclosed herein are methods and compositions related to powder metallurgy of titanium and titanium alloys, as well as methods of using these compositions in aircraft, automotive, naval applications, oil equipment, chemical apparatus, and other industries. More particularly, there is disclosed herein methods for the manufacture of near-net shape titanium articles from sintered elemental and alloyed powders. These articles have close size tolerances, which eliminate or minimize the need for machining Description of Related Art Titanium alloys are known to exhibit light weight, high resistance to oxidation or corrosion, and the highest specific strength (the strength-to-weight ratio) of all metals except beryllium. Articles of titanium alloys have been produced by melting, forming, and machining processes, or by certain powder metallurgy techniques. However, the first method is not cost effective (although it provides high levels of desired properties of titanium alloys). The second method is cost effective but as previously implemented cannot completely realize all of the desirable advantages of titanium alloys.

Various processes have been developed during the last four decades for the fabrication of near-net shape titanium articles from powders with desirable density and mechanical properties. The use of elemental powder mixtures, control of the particle size distribution, vacuum sintering, hot isostatic pressing, and special surface finishing are among those new developments. But all of these processes, as well as conventional powder metallurgy techniques, impose certain limitations with respect to the characteristics of the produced titanium alloys.

For example, the method described in U.S. Pat. No. 4,432,795 (the contents of which are incorporated herein by reference) includes grinding particles of light metals to a median particle size of less than 20 μm, mixing them with particles of titanium based alloys having a median particle size larger than 40 μm, and compacting the mixture by molding and sintering at temperatures less than that of a formation of any liquid phase. This method allows the manufacture of the alloy having a density close to the theoretical value. However, the resulting alloy, contaminated by oxygen, iron, and other impurities, also exhibits insufficient mechanical properties.

U.S. Pat. No. 4,838,935 (the contents of which are incorporated herein by reference) discloses the use of titanium hydride together with titanium powder in the primary mixture before molding and sintering to form tungsten-titanium sputtering targets. The molded article is heated in a hot-press vacuum chamber to a temperature sufficient for the dehydration of $TiH_2$ to remove gases. Then, the article is heated to a second temperature of 1350-1500° C. while maintaining the pressure and vacuum. This method cannot completely prevent the oxidation of highly-reactive titanium powders during the second heating, because hydrogen is permanently outgassing from the working chamber. Also, the method does not provide sufficient cleaning of titanium powder that resulted in deviations of final products from AMS and ASTM specifications. In addition, this method is not suitable for powdered mixtures containing low-melting metal and phases.

A preliminary partial sintering of titanium and titanium hydride powders with at least one powdered additive of alloying metals (selected from powdered Ni, Al, Cu, Sn, Pd, Co, Fe, Cr, Mn, and Si) is disclosed in U.S. Pat. No. 3,950,166 (the contents of which are incorporated herein by reference). The "mother" alloy obtained in such a way is pulverized and remixed with at least one of powdered titanium or titanium hydride, and optionally with powdered metals such as Mo, V, Zr, and Al—V alloys to achieve the final composition of titanium alloy. This mixture is molded in a predetermined shape and sintered at 1000-1500° C. in a vacuum. While the preliminary sintering partially resolves one technical problem (how to improve uniform distribution of alloying components), the process generates another problem (oxidation of the "mother" powder during pulverization).

Several attempts have been made to improve the density and purity of sintered titanium alloys that involve using titanium hydride as the raw material, together with other alloying powders, e.g., in U.S. Pat. No. 3,472,705, which relates to the production of niobium-titanium or niobium-zirconium superconducting strips. This method includes vacuum heating and sintering accompanied with permanent outgassing, where the heating is used to decompose the hydride to metal before sintering. As a result, the "cleaning effect" of hydrogen is not fully obtained, and partial oxidation reoccurs after the removal of hydrogen from the vacuum chamber. Thus, the method does not provide an effective improvement of mechanical properties of sintered alloys, in spite of any sintering that may be promoted by thermal dissociation of titanium hydride.

A particular process for use of titanium hydride powders combined with master alloy powders or elemental powders has been described in U.S. Patent Application Publication No. 2003/0211001 (the entire contents of which are incorporated herein by reference). However, this publication does not describe a process wherein Commercially Pure (C.P.) titanium powder can be used.

Other known processes for making near-net shape titanium alloys from metal powders have the same drawbacks: (a) insufficient purity and low mechanical properties of sintered titanium alloys, (b) irregular porosity and insufficient density of sintered titanium alloys, and (c) low reproduction of mechanical properties that depend on the purity of raw materials. Indeed, the association of the use of hydrides with increased porosity is so well established that hydrides are specifically disclosed as useful when porous bodies are desirable, as in U.S. Pat. No. 4,560,621.

SUMMARY

As a result of the drawbacks of the techniques described above, there remains a need in the art for processes that will increase the mechanical properties, particularly strength and plasticity, of near-net shape articles manufactured by sintering titanium alloys from elemental and/or alloyed metal powders. In order to obtain a high level of mechanical properties, any oxidation or contamination of powdered components must be prevented during heating and sintering.

There also remains a need in the art for processes that provide low porosity and high-density structures of sintered titanium alloys to achieve the densities close to the theoretical value.

There remains a need in the art for processes that provide cost-effective manufacture of near-net shape articles using one-run heating and sintering of powdered titanium alloys.

Finally, there remains a need in the art for processes of sintering titanium and titanium alloy powders mixed and compacted with a titanium hydride ($TiH_2$ containing over 3.4 weight % hydrogen) powder and hydrogenated titanium powders containing less than 3.4 weight % of hydrogen) which provide both low content of all impurities and improved mechanical properties of the final product in order to meet requirements of such industrial specs as AMS and ASTM.

Some or all of the needs described above can be met by the methods described herein, and by the near-net shape sintered titanium articles that result therefrom. The disclosed methods relate to embodiments of processes for the manufacture of near-net shape titanium articles from sintered powders containing commercially pure (C.P.) titanium and/or hydrogenated titanium powders, and/or titanium alloys with all required alloying elements. The embodiments of the methods disclosed herein resolve many or all of the problems related to high impurities, insufficient strength, irregular porosity, insufficient density, and cost reductions that have been described above, and that have not been solved by prior processes.

The embodiments of the methods described herein overcome these problems by sintering in the presence of atomic hydrogen emitted by the hydrogenated titanium powders.

In one embodiment, the process includes:

(a) forming a powder blend by mixing (1) Commercially Pure (C.P.) titanium powder, and (2) one or more of (i) one or more hydrogenated titanium powders containing around 3.4 to around 3.9 weight % of hydrogen (e.g., hydrogenated titanium powders available or referred to nominally as "titanium hydride" or $TiH_2$), and (ii) one or more hydrogenated titanium powders containing around 0.2 to around 3.4 weight % of hydrogen, (b) consolidating the powder blend by either compacting the powder blend using die pressing, direct powder rolling, cold isostatic pressing, impulse pressing, metal injection molding, other room temperature consolidation method, or combination thereof, at a pressure in the range of around 400 to around 960 MPa, or loose sintering, to provide a green compact having a density lower than that of a green compact formed from only C.P. titanium powder, such that the subsequent sintering of said green compacts is promoted by an increased hydrogen content retained in the green compact which provides emission of atomic hydrogen and a high partial pressure during subsequent cleaning and sintering steps, (c) heating the green compact to a temperature ranging from around 100° C. to around 250° C. at a heating rate ≤around 15° C./min, thereby releasing absorbed water from the titanium powder, and holding the green compact at this temperature for a holding time ranging from around 10 to around 360 min, wherein the holding time and a thickness of the green compact are such that there is around 20 to around 24 min of holding time per every 6 mm of the thickness of the green compact, (d) forming β-phase titanium and releasing atomic hydrogen from the hydrogenated titanium by heating the green compact to a temperature of around 400 to around 600° C. in an atmosphere of hydrogen emitted by the hydrogenated titanium and holding the green compact at this temperature for around 5 to around 30 min thereby forming and releasing reaction water from the hydrogenated titanium powder, (e) reducing surface oxides on particles of the titanium powder by contact with atomic hydrogen released by heating of the green compact to a temperature of around 600 to around 700° C. and holding at this temperature for a holding time of around 30 to around 60 min sufficient to transform β-phase titanium into α-phase titanium while preventing dissolution of oxygen in the metallic body of the titanium particles and simultaneously providing maximum cleaning of titanium powders before forming closed pores, (f) diffusion-controlled chemical homogenizing of the green compact and densification of the green compact by heating to around 800 to around 850° C. at a heating rate of around 6 to around 8° C./min, followed by holding at this temperature for 30-40 min resulting in complete or partial dehydrogenation and more active shrinkage of titanium powder formed from the initial hydrogenated titanium powder to form a cleaned and refined compact, (g) heating the cleaned and refined green compact in vacuum at a temperature in the range of around 1000 to around 1350° C., and holding the cleaned and refined green compact at such temperature for at least around 30 minutes, thereby sintering titanium to form a sintered dense compact, and (h) cooling the sintered dense compact to form a sintered near-net shaped article.

In another embodiment, the process includes:

(a) forming a powder blend by mixing two or more hydrogenated titanium powders containing around 0.2 to around 3.9 weight % of hydrogen, (b) consolidating the powder blend by either compacting the powder blend using die pressing, direct powder rolling, cold isostatic pressing, impulse pressing, metal injection molding, other room temperature consolidation method, or combination thereof, at a pressure in the range of around 400 to around 960 MPa, or loose sintering, to provide a green compact having a density lower than that of a green compact formed from only C.P. titanium powder, such that the subsequent sintering of said green compacts is promoted by an increased hydrogen content retained in the green compact which provides emission of atomic hydrogen and a high partial pressure during subsequent cleaning and sintering steps, (c) heating the green compact to a temperature ranging from around 100° C. to around 250° C. at a heating rate ≤around 15° C./min, thereby releasing absorbed water from the titanium powder, and holding the green compact at this temperature for a holding time ranging from around 10 to around 360 min, wherein the holding time and a thickness of the green compact are such that there is around 18 to around 24 min of holding time per every 6 mm of the thickness of the green compact, (d) forming β-phase titanium and releasing atomic hydrogen from titanium hydride by heating the green compact to a temperature of around 400 to around 600° C. in an atmosphere of hydrogen emitted by the hydrogenated titanium and holding the green compact at this temperature for around 5 to around 30 min thereby forming and releasing reaction water from the hydrogenated titanium powder, (e) reducing surface oxides on particles of the titanium powder by contact with atomic hydrogen released by heating of the green compact to a temperature of around 600 to around 700° C. and holding at this temperature for a holding time of around 30 to around 60 min sufficient to transform β-phase titanium into α-phase titanium while preventing dissolution of oxygen in the metallic body of the titanium particles and simultaneously providing maximum cleaning of titanium powders before forming closed pores, (f) diffusion-controlled chemical homogenizing of the green compact and densification of the green compact by heating to around 800 to around 850° C. at a heating rate of around 6 to around 8° C./min, followed by holding at this temperature for a holding time of around 30 to around 40 min resulting in complete or partial dehydrogenation and more active shrinkage of titanium powder formed from the initial hydrogenated titanium powder to form a cleaned and refined compact, (g) heating the cleaned and refined green compact in vacuum at a temperature in the range of around 1000 to around 1350° C., and holding the cleaned and refined green compact at such temperature for at least around 30 minutes, thereby sintering titanium to form a sintered dense compact, and (h) cooling the sintered dense compact to form a sintered near-net shaped article.

The initial mixture of metal powders (the powder blend) can additionally comprise a powder prepared from under-separated titanium sponge, or alloying metal powders selected from master alloy powders, or alloy mixture of elemental powders, or pre-alloyed titanium powders, or combinations of these.

The powder blend can comprise, in addition to C.P. titanium powder, only the hydrogenated titanium powders containing different amount of hydrogen in the range of 0.2-3.9 wt. %. Alternatively, the powder blend may contain only the hydrogenated titanium powders, or may exclude the C.P. titanium powder, as indicated in the embodiment described above.

Further decreasing of the residual hydrogen content to below around 150 ppm may be achieved during subsequent high temperature processing (e.g., forging, rolling, hot isostatic pressing (HIP), extrusion, or combinations of these) followed by vacuum annealing at temperatures of around 700 to around 750° C.

In an alternative embodiment, formation of the β-phase titanium and releasing of atomic hydrogen from the hydrogenated titanium powder is carried out by slow heating, i.e., heating the green compact to a temperature ranging from about 250° C. to about 600° C. in an atmosphere of emitted hydrogen at the heating rate ≤around 15° C./min to enhance the chemical reduction and cleaning effect of the emitted hydrogen and to release reaction water from titanium hydride and hydrogenated titanium powders.

In order to accumulate crystal defects for additional activation of sintering titanium particles, multiple initiation of alpha-beta-alpha phase transitions in titanium green compact is carried out by thermal cycling at temperatures in the range of around 800 to around 900° C.

As indicated above, in a particular embodiment, consolidating of the powder blend can result from compaction, or from loose sintering. Loose sintering can be used without use of room temperature consolidation. In this case, a 40% to 90% dense sintered preform is further processed by high temperature deformation (forging, rolling, extrusion, etc.) to reach the required full theoretical density, which can be followed by the appropriate annealing or other stress relief operations. Cleaning of titanium particles by emitted atomic hydrogen is facilitated in the loose-sintered green compact due to the developed porosity of the material.

In a particular embodiment, the dehydrogenation taking place during sintering operations may be disrupted at a temperature above around 800° C. before the completion of hydrogen evacuation in order to reserve residual hydrogen, which can be useful or necessary for reducing the deformation forces, grain refinements, and/or other positive effects such as additional cleaning of sintered titanium article during subsequent hot processing by forging, rolling, HIP, and/or extrusion.

The embodiments disclosed herein are particularly useful when forming parts having complex shapes, in particular when forming shapes with variations in their thickness that are being compacted in the thickness direction, and when the difference in green densities are very pronounced and cannot be avoided, because the use of hydrogenated titanium powders allows the disclosed process to reach near full density during sintering, which is impossible to achieve when non hydrogenated titanium powder is used.

The hydrogenated titanium powders are present in an amount of 10-90 wt. % of the powder blend, while other titanium powders (C.P. titanium powder, underseparated titanium powder, etc.) is present in an amount of 5-20 wt. % of the powder blend. These titanium powders may be also hydrogenated prior to the blending operation.

In particular embodiments, the resulting sintered near-net shape titanium article desirably contains less than 0.2 wt. % of oxygen, less than 0.006 wt. % of hydrogen, less than 0.05 wt. % of chlorine, less than 0.05 wt. % of magnesium, less than 10 ppm of sodium, and desirably has a final porosity less than 1.5% at pore sizes less than 20 microns. This low interstitial content achieved by our process makes the resulting titanium and titanium alloys weldable, which was not achievable by prior art.

In particular embodiments, initial heating is desirably performed at a slow rate, e.g., at a rate of ≤15° C./min.

In another embodiment, the invention relates to a process for producing titanium alloy parts with particularly close size tolerances, comprising providing a blend of raw materials, including titanium hydride powder and alloying powders, e.g., by blending these raw materials in the desired quantities, then molding, e.g. by die pressing, this blend to form green pre-forms of the desired article. Desirably, a mixture of around 10% by weight of a master alloy containing 60% by weight Al and 40% by weight V is blended with titanium hydride powder in an amount of about 90% by weight Ti, to achieve an overall alloy of Ti-6Al-4V. Desirably, these powders have fine particle sizes, typically having an average particle size that is less than 150 microns, typically of around 100 microns or less.

These green pre-forms are then dehydrogenated at relatively low temperatures (e.g., 400° C. to 900° C.) thereby emitting a significant portion of the hydrogen contained therein, e.g., all or most of the hydrogen contained therein, but without fully sintering of the article, so that any master alloy contained therein is not completely diffused through the article. Desirably, the green pre-forms are sintered to 60-85% of theoretical density. The dehydrogenated, partially sintered articles are sized or coined, preferably at room temperature, which increases their density from about 60%-85% of theoretical density to about 80% to 95% of theoretical density. After sizing or coining, the articles are subjected to a high-temperature sintering, which increases their density to 99% or higher of theoretical density.

The dehydrogenated titanium alloy articles are slightly shrunken with respect to the size of the molded green pre-forms, but are believed to contain a "soft" titanium matrix phase with master alloy evenly distributed therein. For example for a Ti-6Al-4V alloy, a master alloy of 60% Al and 40% V is distributed at a concentration of 10% by weight within a titanium matrix in an amount of 90% by weight.

Using this process, shrinkage during final sintering is significantly decreased. More particularly, linear shrinkage during final sintering is 3% or less, instead of the 7% to 9% of linear shrinkage typically observed when a single high temperature sintering step is used. This allows for considerably better control of the final sizes of the articles. Without wishing to be bound by theory, it is believed that the removal of hydrogen and the partial shrinkage during the dehydrogenation/partial sintering step provides for the reduced shrinkage during final sintering, and the production of articles with closer tolerances.

In addition, other beneficial effects, such as refined microstructures resulting from this process also improve the properties of the finished articles. For example, at least in part due to the fine particle sized titanium hydride and master alloy powders used, grain growth during sintering is limited, so that the microstructure of the sintered parts has fine grains, typically having an average grain size in the range of about 100 to about 150 microns, which improves the mechanical and chemical properties of the finished articles.

The sizing or coining of the partially sintered articles involves plastically deforming the article to improve its dimensional accuracy. This corrects any slight changes in size, or shape or individual dimensions that may occur during partial sintering, and brings the partially sintered parts into the required sizes and tolerances.

In another embodiment, the invention relates to a method for the manufacture of near-net shape titanium and titanium alloy articles from metal powders comprising:

(a) providing a powder blend comprising (1) one or more hydrogenated titanium powders containing around 0.2 to around 3.4 weight % of hydrogen, and (2) one or more master alloys, comprising Al, V, or a combination thereof, (b) consolidating the powder blend by compacting the powder blend to provide a green compact, (c) heating the green compact to a temperature ranging from around 400° C. to around 900° C., thereby releasing the majority or all of the hydrogen from the hydrogenated titanium, and partially sintering the green compact without fully sintering it, to obtain a partially sintered article having a density of about 60% to about 85% of theoretical density, (d) sizing the partially sintered article at a temperature at or around room temperature to obtain an sized article having a density of about 80% to about 95% of theoretical density, (e) heating the sized article in vacuum thereby sintering the article to form a sintered dense compact having a density of 99% of theoretical density or higher.

In a particular embodiment, the sized article exhibits a linear shrinkage of 3% or less during step (e).

Another particular embodiment further comprises subjecting the article obtained from step (e) to (f) hot processing selected from the group consisting of forging, rolling, hot isostatic pressing (HIP), extrusion, and combinations of these.

Another particular embodiment further comprises subjecting the article obtained from step (e) to (g) grinding, or (h) tumbling, or both.

In another particular embodiment, the consolidating of the green compact comprises molding of the powder blend.

In another particular embodiment, the step (c) results in a material wherein all or most of the hydrogen is emitted, and full sintering of the material has not occurred.

In another particular embodiment, the step (c) results in a soft material having a soft titanium matrix within which is evenly distributed a master alloy.

In a particular embodiment, the master alloy comprises 60% Al and 40% V.

In a particular embodiment, the master alloy is present in the titanium matrix in a concentration of around 10%.

In a particular embodiment, the step (e) provides a linear shrinkage of 3% or less.

In a particular embodiment, the hydrogenated titanium powder, the master alloy powder, or both, have an average particle size less than about 150 microns.

In a particular embodiment, the hydrogenated titanium powder, the master alloy powder, or both, have an average particle size greater than 100 microns.

In a particular embodiment, the partially sintered article has an average grain size between about 100 microns and about 150 microns.

Another embodiment relates to a near net shape titanium alloy article produced by the process described herein.

The embodiments described herein are desirable because they can provide a method to manufacture near-net shape sintered titanium articles in a cost-effective way as a result of performing all process operations within one or two thermal cycles for one or two furnace runs. This is, at least in part, the result of control of the purity and mechanical properties of sintered titanium alloys using (a) particularly desirable thermal processing of titanium, and hydrogenated titanium powders and control of atomic hydrogen emitted from the hydrogenated powders during heating in vacuum, (b) control of open porosity and hydrogen cleaning of titanium and titanium alloy particles at different steps of the thermal cycle during the sintering process, and (c) control of alpha-beta transformation of titanium in conjunction with porosity, cleaning, and densification of green compact depending on the presence, pressure, and activity of emitted hydrogen in the furnace chamber during the heating and sintering.

BRIEF DESCRIPTION OF DRAWINGS

The embodiments described herein can be understood by reference to the accompanying drawings, which are intended to be illustrative, rather than limiting.

FIG. 6A shows the microstructure before hot isostatic pressing (HIP), and FIG. 6B shows the microstructure after HIP.

FIG. 7A shows the microstructure before hot isostatic pressing (HIP), and FIG. 7B shows the microstructure after HIP.

DETAILED DESCRIPTION OF SPECIFIC EMBODIMENTS

The methods described herein can be more clearly understood by reference to the following description of specific embodiments and examples, which are intended to illustrate, rather than limit, the scope of the appended claims.

As used herein, the terms "around" or "about" in connection with a numerical value denote a deviation from the numerical value of ±5%. As used herein, the term "hydrogenated titanium powders" includes titanium powders having hydrogen contents ranging from about 0.2 to about 3.9 wt %. This includes hydrogenated titanium particles nominally described as "titanium hydride" or "$TiH_2$", as well as other hydrogenated titanium particles having hydrogen contents within the indicated range, and combinations thereof, unless otherwise indicated. For example, this terminology can include hydrogenated titanium powder containing hydrogen in an amount ranging from 0.2 wt % up to and including 3.4 wt %, as well as hydrogenated titanium powder containing hydrogen in an amount above 3.4 wt % and up to and including 3.9 wt %, the latter being sometimes denominated as "titanium hydride" or "$TiH_2$ powder."

As described above, the methods disclosed herein relate generally to the manufacture of sintered titanium and titanium alloys using elemental metal powders and titanium hydride and/or hydrogenated titanium powders as raw materials. It has been found that the atomic hydrogen emitted from titanium hydride and hydrogenated titanium powders before formation of molecular hydrogen plays a very important role in chemical reduction and cleaning of the titanium particles with respect to oxygen and other impurities such as chlorine, magnesium, sodium, and in preventing oxidation during heating and sintering, as well.

Previously known methods, as described above, have not been able to determine the desirable process steps and parameters described herein in order to provide effective action of emitted atomic hydrogen and control of porosity and densification of compacted titanium particles to reach maximum possible density, purity, and mechanical properties of final sintered articles. Previous methods described above have used permanent outgassing of the vacuum chamber during heating and sintering. As a result, a complete reaction between metal powders in green titanium compacts with hydrogen is not achieved, and the final structure of the sintered alloy contains oxides, other impurities, and irregular porosity.

Figure 1:
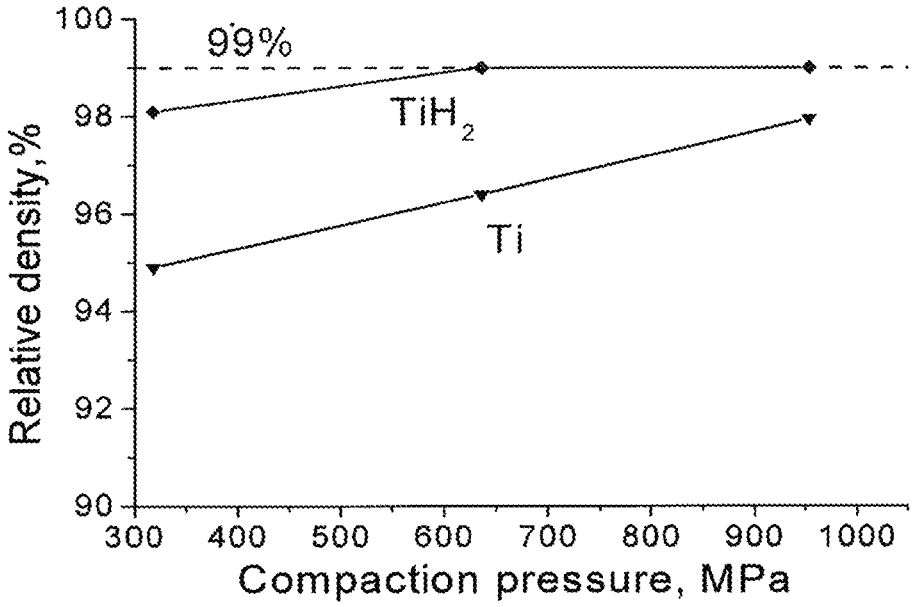
FIG. 1 is a graph showing the relationship between compaction pressure used to produce a green compact, and the relative density of the sintered articles prepared from Ti powder alone and from Ti powder combined with hydrogenated titanium powder according to an embodiment disclosed herein.

In particular embodiments described herein, one or more of the hydrogenated titanium powders used was compacted to a relatively low density in the green samples (3.06 g/cm$^3$) as compared to green samples prepared from titanium powder alone (3.47 g/cm$^3$). However, after sintering, the converse was true, and the C.P.-Ti samples produced using hydrogenated titanium powder had a higher density (4.43 g/cm$^3$, i.e. 98.2%) than those sintered from Ti powder alone (4.37 g/cm$^3$, 97.0%). This result confirms the advantage of using hydrogenated titanium powders to form the powder blend with respect to achieving higher sintered density, as shown in FIG. 1, and is contrary to what would have been expected based on, e.g., U.S. Pat. No. 4,560,621. Similar results were obtained for Ti-6Al-4V compositions prepared according to the methods disclosed herein. The influence of the emitted hydrogen on sintered density becomes clear from an analysis of the effects of hydrogenated titanium upon compaction and heating processing stages of the disclosed methods, which determines final density.

The emitted atomic hydrogen beneficially affects sintering kinetics, helps to reduce any oxides that are usually located on the surface of powder particles, and by doing so, is cleaning inter-particle interfaces and enhancing the diffusion between all components of the powder mixture.

We discovered from our experimental studies that the positive effect of emitted hydrogen in titanium sintering can be significantly enhanced by the control of pressure, temperature and time within the sintering process. In particular, we found that the best reduction of surface titanium oxides by emitted atomic hydrogen occurs at particular combinations of the hydrogen pressure and temperature, as shown in FIG. 2.

Figure 2:
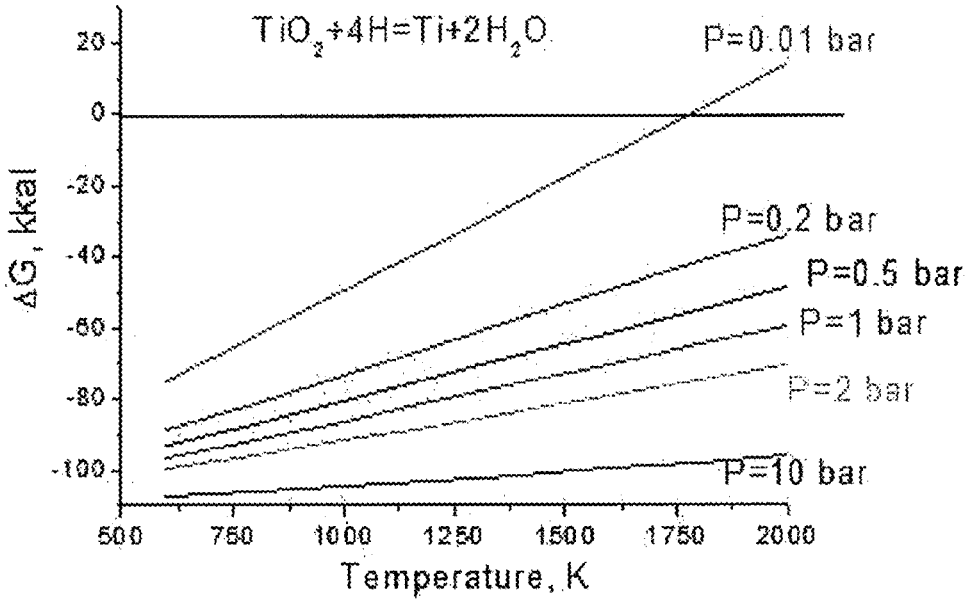
FIG. 2 is a graph showing the relationship between change in free energy and temperature for different hydrogen pressures during sintering according to an embodiment disclosed herein.

In FIG. 2, all pressure-temperature combinations below the line of $\Delta G=0$ provide reduction of titanium oxide, while there is no reduction reaction by the emitted atomic hydrogen at the pressure-temperature combinations above this line. This means that permanent outgassing during sintering with titanium hydride (which has been used in prior art methods described above) may result in ineffective reduction of surface titanium oxides from titanium particles, and as a result, in the presence of excessive or undesirably amounts of oxygen in the final sintered product.

Without wishing to be bound by any theory, it is believed that a characteristic feature of the hydrogenated titanium powders used in the methods disclosed herein is the ability to undergo a dehydrogenation process, i.e. a process of hydrogen evolution from the material, and the resulting significant shrinkage during vacuum heating above 320° C. The temperature interval of dehydrogenation and corresponding changes in the phase composition depend on the heating rate and the rate of hydrogen evacuation from the heating chamber. Relatively slow heating (e.g., a heating rate of ≤15° C./min (preferably ~7° C./min) led to a phase change represented by $TiH_2 \rightarrow \beta \rightarrow \alpha$ and which is a consequence of phase transformations, and completion of dehydrogenation at a temperature of about 800° C. The intensity of hydrogen evolution varied within the mentioned temperature range and was determined by diffusion rate of hydrogen in the phases towards the powder particle surface. The most intensive dehydrogenation with evolution of a major portion of hydrogen from the material was observed within a temperature range of about 400 to about 600° C., and is believed to be due to the formation of the β-phase, in which hydrogen diffusivity is the fastest. Decreases in hydrogen concentration are believed to lead to the α-phase formation at temperatures of about 600 to about 650° C. as a final product of dehydrogenation, and to the evolution of a small portion of residual hydrogen from the α phase at further heating up to 800° C.

Significant volume changes in the material that occur during dehydrogenation resulted in a much more considerable shrinkage of compacts prepared using hydrogenated titanium powder as compared to compacts prepared using only titanium metal powder. Shrinkage of compacts prepared using hydrogenated titanium powder is determined by dehydrogenation (below 800° C.) and sintering of powders and the contribution of the latter becomes apparent at the final stage of dehydrogenation and at higher temperatures. By contrast, the volume changes observed for compacts prepared using only titanium metal powders were determined by the mechanism of powder sintering only.

Other positive effects of using hydrogenated titanium powders in the powder blend and compacting the blend are (a) relative independence of final (sintered) density on the green density in different cross-sections of the sintered article, (b) the possibility of varying shrinkage to get the precise desired final article dimensions at near full theoretical density, and (c) the ability to have compaction stresses relaxed in more ductile titanium powder.

Figure 3:
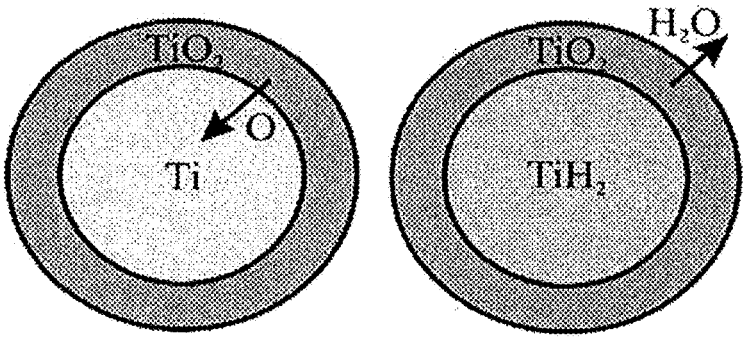
FIG. 3 is a schematic diagram illustrating two mechanisms for disappearance of oxide films on surfaces of particles of Ti metal and hydrogenated titanium.

We also found that effectiveness of hydrogen cleaning depends on: (a) the state of oxygen in the titanium particles and (b) the type of porosity of the green compact that interacts with emitted atomic hydrogen. We found that the decrease of oxygen content by hydrogen reduction is especially important for powder material in which surface area is highly developed. On the other hand, this mechanism cannot decrease oxygen content if oxygen is in solid solution. FIG. 3 schematically illustrates a competition between two processes involving oxide films on the powder surfaces—either to be reduced by hydrogen or to be dissolved through diffusion of oxygen into the powder interior volume.

We found that the second process proceeds in vacuum at temperatures roughly above 700° C., but in this case oxygen goes inside and remains in the material. As a result, the first process (reducing by hydrogen) should proceed before the oxide dissolution. Therefore it is important to have hydrogen release from the powder particles and the respective reaction of oxide reducing before the oxide film dissolution in the titanium particle body. Control of the sintering thermal cycle by control of the heating rate and of the holding step in the temperature range of about 400 to about 600° C. significantly improve cleaning of oxygen from the particles of the titanium green compact.

The second feature of the hydrogen cleaning process occurring in the methods disclosed herein is transformation of open porosity to closed porosity. It has been found that this also happens at temperatures of around 700° C. After this, products of reacting hydrogen with surface impurities will be located inside of the titanium material, and either the reaction will stop due to excessive pressure in the closed pore, or the reaction products will dissolve themselves in titanium instead of reacting with hydrogen at the surface. This relates especially to magnesium and magnesium chloride impurities that should evaporate at the higher temperature of sintering.

As a result, the transformation of open porosity to closed porosity should be delayed until as late as possible in order to reach a high grade of cleaning of all impurities. This can be done by control of the heating rate at a temperature below 700° C. to reserve a part of the hydrogen for reacting at higher temperatures and providing holding steps at temperatures below those at which closing of pores occurs.

Figure 4:
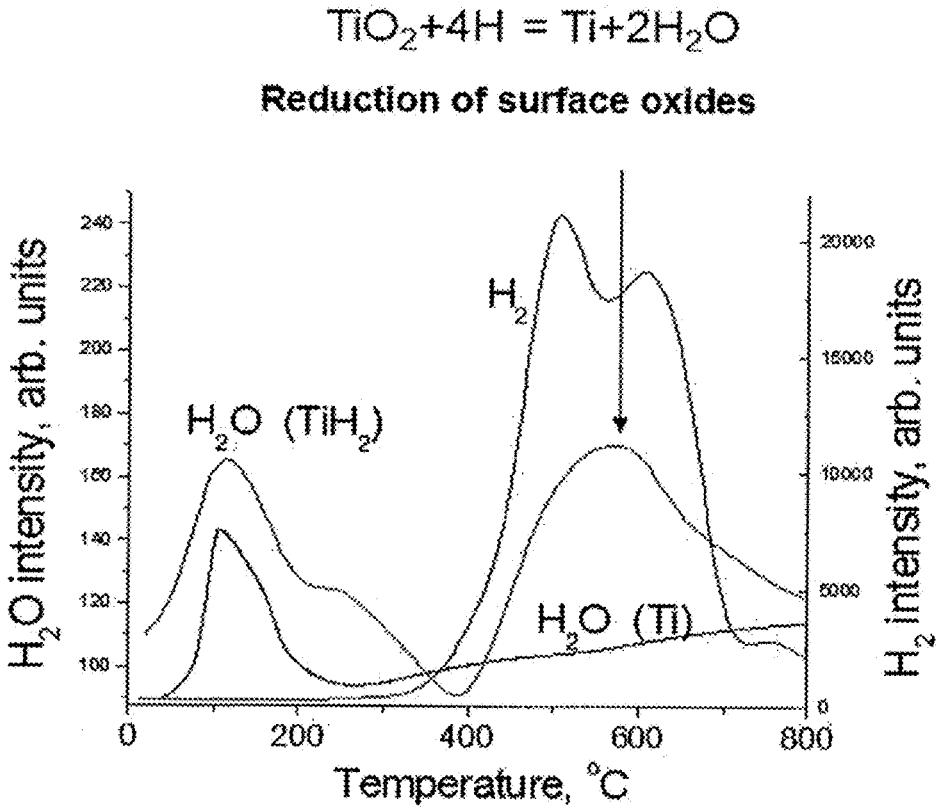
FIG. 4 is a graph showing mass spectrometry curves that illustrate the relationship between released water, hydrogen emission, and temperature for processing according to embodiments disclosed herein.
Figure 5:
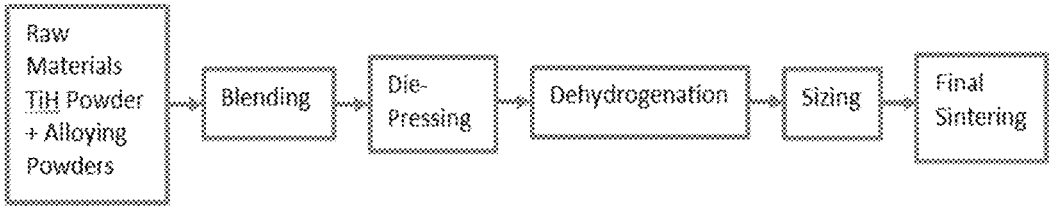
FIG. 5 is a process flow diagram for production of titanium alloy articles according to an embodiment of the invention.

One more very important feature of using hydrogenated titanium powders as described herein is the release of $H_2O$ that we observed within the interval of hydrogen emission illustrated by FIG. 4. FIG. 4, shows mass-spectrometry curves of $H_2O$ and $H_2$ gas release upon heating of titanium metal powdered compacts (curve Ti) and compacts prepared from hydrogenated titanium powders (curve $TiH_2$). A low-temperature $H_2O$ peak is present for both the $TiH_2$ and Ti compacts and, without wishing to be bound by theory, is believed to be related to the atmospheric moisture absorbed on the powders. However, another $H_2O$ peak was observed in the curve for the $TiH_2$ compact above 400° C., but absent from the curve for the Ti compact. The emission of $H_2O$ during hydrogen evolution (indicated by the third curve) can be explained by the reduction of surface oxide scales and cleaning of the powder particle surfaces by emitted atomic hydrogen evolved according to the reaction: $TiO_2+4H \rightarrow Ti+2H_2O$.

The dehydrogenation during the heating step, with the resulting phase transformations, volume changes, and reduction of surface oxides, is a distinct feature of the use of hydrogenated titanium powders as described herein, and has beneficial consequences which affect the sintering and properties of final material.

The alpha-beta phase transformations and significant shrinkage due to decrease in hydrogen concentration results in an increased amount of crystal lattice defects, and, hence, activation of diffusion processes. The high specific surface area of hydrogenated titanium powders that are crushed upon compaction also contributes to an acceleration of diffusion and improved sintering at further heating. Moreover, a cleaning effect of hydrogen evolved has two useful consequences.

The oxide scales at powder surfaces are effective barriers for diffusion, which can prevent or limit the sintering of compacted particles. For titanium powder, sintering becomes possible above ~700° C. when dissolution of $TiO_2$ scales occurs due to diffusion of oxygen atoms from the surface deep into the titanium. For hydrogenated titanium powders, hydrogen leaving a particle reduces the surface oxide scales (at least partially) before their dissolution and diffusion into the titanium particle, thus promoting a mass transfer between particles and decreasing oxygen content in dehydrogenated titanium.

As a positive effect of all these factors, dehydrogenation as described herein resulted in the formation of highly activated titanium and its improved sintering as compared to a common Ti powder. It can be seen from FIG. 1 that above 800° C., when dehydrogenation is already completed, the initially hydrogenated compact demonstrated noticeably more active shrinkage than the sample made from titanium metal powder. It is believe that first diffusion contacts between hydrogenated titanium particles formed under heating already at 710° C., i.e. before the dehydrogenation completion.

In order to enhance the above mentioned effect of alpha-beta phase transformation, we have found that thermal cycling in the temperature range of about 800 to about 900° C. is advantageous. Without wishing to be bound by theory, it is believed that this helps to accumulate crystal defects for additional activation of sintering titanium particles.

In addition, we found that methods for hot processing of the sintered titanium compact, such as forging, rolling, HIP, and/or extrusion, followed by vacuum annealing at temperatures of around 700 to around 750° C., results in further decrease of the content of residual hydrogen to below 150 ppm.

Optionally, the powder blend can comprise only hydrogenated titanium powders having the hydrogen contents described above, i.e., that contain different amounts of hydrogen in the range of 0.2-3.9 wt. %, for example, a powder blend that comprises three hydrogenated titanium powders with 0.2 wt. % of hydrogen, 2.0 wt. % of hydrogen, and 3.8 wt. % of hydrogen, respectively. During processing according to the embodiments described herein, it is believed that a powder having the lowest content of hydrogen becomes pure titanium powder due to dehydrogenation at an early point of the sintering process.

The embodiments of the process of the manufacture of net-shape titanium and titanium alloy articles described herein and the effects and features of sintering titanium particles in presence of atomic hydrogen that we found experimentally allow the manufacture of sintered titanium and titanium alloy articles with extremely low content of oxygen, hydrogen, and other impurities that meet industrial requirements of ASM and ASTM specifications, e.g.: less than 0.2 wt. % of oxygen, less than 0.006 wt. % of hydrogen, less than 0.05 wt. % of chlorine, less than 0.05 wt. % of magnesium, and wherein the resulting sintered titanium article has a final porosity less than 1.5% at pore sizes less than 20 microns. Low interstitial content made these titanium and titanium alloys weldable, which was not enabled in previously produced powder metallurgy alloys.

The resulting sintered articles have high mechanical properties such as tensile strength, yield strength, and elongation meet or exceed the requirements of the above specifications as indicated in the examples.

The foregoing examples of the invention are illustrative and explanatory. The examples are not intended to be exhaustive and serve only to show the possibilities of the technology disclosed herein.

Example 1

A powder blend of three hydrogenated titanium powders containing different amount of hydrogen was used: (1) 25% of hydrogenated titanium powder containing 0.5 wt. % of hydrogen, particle size <45 microns, (2) 25% of hydrogenated titanium powder containing 2 wt. % of hydrogen, particle size <100 microns, and (3) 50% of titanium hydride $TiH_2$ powder containing 3.8 wt. % of hydrogen, particle size <120 microns. These powders were mixed together, and the obtained mixed powder was compacted at 720 MPa to a low density green compact of 3.05 g/cm$^3$.

The green compact, having the thickness 12 mm, was heated to 250° C. at a slow heating rate of ~7° C./min and held at this temperature for 40 min to release absorbed water from the titanium powder. Then, heating was continued at the heating rate of ~22° C./min to a temperature in the range of 480-500° C. in the atmosphere of emitted hydrogen, and held at this temperature for 30 min to form β-phase titanium and to release reaction water from the hydrogenated titanium powders.

Almost complete reduction of surface oxides of the green compact particles by emitted atomic hydrogen was carried out by further heating the green compact to a temperature of 630° C. and holding at this temperature for 45 min, when the green compact still had open porosity structure. At the same time, β-phase titanium was transformed to α-phase titanium.

Further, the diffusion-controlled chemical homogenization was carried out by heating of green compact to 820° C. with a heating rate of 7° C./min and holding at this temperature for 30 min, which resulted in densification of the green compact to a density of 4.44 g/cm$^3$ due to completion of dehydrogenation and active shrinkage of the green compact.

Then, heating of the cleaned and refined green compact was continued in a vacuum of $10^{-4}$ Torr at a heating rate of 5-10° C./min to a temperature 1220° C., followed by holding at this temperature for 3.5 hours to form a sintered dense compact, and finally, cooling the sintered compact was done to obtain a flat titanium plate.

The titanium plate was hot rolled to the thickness of 8 mm, followed by vacuum annealing at 750° C. for 1.5 hours.

The measured contents of impurities in the final product were the following:

oxygen <0.15 wt. %,
hydrogen <0.005 wt. %,
chlorine <0.001 wt. %,
magnesium <0.003 wt. %,
sodium <10 ppm.

Standard specimens for mechanical testing were cut and machined from the titanium plate, which has a refined microstructure. Mechanical properties of the manufactured titanium plate were found to be: ultimate tensile strength 552-571 MPa, yield strength 489-510 MPa, and 21-23% elongation.

Example 2

A powder blend of two types of powders was used: (1) 20% of CP titanium powder, which does not contain hydrogen at all, particle size <150 microns, and (2) 80% of titanium hydride $TiH_2$ powder containing 3.5 wt. % of hydrogen, particle size <100 microns.

These powders were mixed together, and the obtained mixed powder was compacted at 780 MPa to a low density green compact of 3.24 g/cm$^3$.

The green compact having the thickness 24 mm was heated to 230° C. at a slow heating rate of ~7° C./min and held at this temperature for 80 min to release absorbed water from the powder. Then, heating was continued at the heating rate of ~22° C./min to 560-580° C. in the atmosphere of emitted hydrogen and held at this temperature for 25 min to form β-phase titanium and release reaction water from the powder.

Almost complete reduction of surface oxides of green compact particles by emitted atomic hydrogen was carried out by further heating the green compact to 700° C. and holding at this temperature for 35 min when the green compact still had open porosity structure. At the same time, β-phase was transformed to α-phase titanium.

Further, the diffusion-controlled chemical homogenization was carried out by heating of green compact to 830° C. with the rate of 7° C./min and holding at this temperature for 20 min that was resulted in densification of green compact to 4.41 g/cm$^3$ due to complete dehydrogenation and active shrinkage of compact containing both titanium and titanium hydride components.

Then, heating of the cleaned and refined green compact was continued in vacuum of $10^{-4}$ Torr at the rate of 5-10° C./min to the temperature 1240° C. followed by holding at this temperature for 4 hours to form a sintered dense compact, and finally, cooling the sintered compact was done to obtain a flat titanium plate.

The titanium plate was hot rolled to the thickness of 20 mm followed by vacuum annealing at 720° C. for 3.5 hours.

Measured contents of impurities in the final product were the following:

oxygen <0.14 wt. %,
hydrogen <0.006 wt. %,
chlorine <0.001 wt. %,
magnesium <0.004 wt. %,
sodium <10 ppm.

Standard specimens for mechanical testing were cut and machined from the titanium plate, which has a refined microstructure. Mechanical properties of the manufactured titanium plate were: ultimate tensile strength 567-582 MPa, yield strength 498-526 MPa, and 18-20% elongation.

Example 3

A powder blend of three types of powders was used: (1) 70 wt. % of titanium hydride powder $TiH_2$ containing 3.8 wt. % of hydrogen and having particle size less than 120 μm, (2)

20% wt. % of CP titanium powder, which does not contain hydrogen, particle size <150 microns, and (3) 10 wt. % of the 60Al-40V master alloy powder having particle size <65 μm.

These powders were mixed together, and the obtained mixed powder was compacted at 960 MPa to a low density green compact of 3.46 g/cm$^3$.

The green compact having the thickness 16 mm was heated to 250° C. at a slow heating rate of ~7° C./min and held at this temperature for 50 min to release absorbed water from the powders. Then, heating was continued at a heating rate of ~20° C./min to 580-600° C. in the atmosphere of emitted atomic hydrogen and held at this temperature for 30 min to form β-phase titanium and release reaction water from the powder.

Almost complete reduction of surface oxides of green compact particles by emitted hydrogen was carried out by further heating the green compact to 680° C. and holding at this temperature for 50 min when the green compact still had open porosity structure. At the same time, β-phase titanium was transformed to α-phase titanium.

Further, the diffusion-controlled chemical homogenization was carried out by heating of green compact to 850° C. with the rate of 7° C./min and holding at this temperature for 30 min that was resulted in densification of green compact to 4.47 g/cm$^3$ due to complete dehydrogenation and active shrinkage of the compact containing both titanium and hydrogenated titanium components.

Then, heating of the cleaned and refined green compact was continued in vacuum of $10^{-4}$ Torr at the rate of 5-10° C./min to the temperature 1250° C. followed by holding at this temperature for 4.5 hours to form a sintered dense compact, and finally, cooling the sintered compact was done to obtain a flat titanium plate.

The titanium alloy Ti-6Al-4V plate was hot rolled to the thickness of 12 mm followed by vacuum annealing at 750° C. for 3 hours.

Measured contents of impurities in the final product were the following:

oxygen <0.15 wt. %,
hydrogen <0.0055 wt. %,
chlorine <0.001 wt. %,
magnesium <0.004 wt. %,
sodium <10 ppm.

Standard specimens for mechanical testing were cut and machined from the titanium alloy plate, which has a refined microstructure. Mechanical properties of the manufactured titanium plate were: ultimate tensile strength 979-1041 MPa, yield strength 889-910 MPa, and elongation at break 15-18%. Due to low content of contaminants, the resulting titanium alloy plate is weldable using both GTAW and GMAW arc welding technique.

Example 4

A powder blend of two types of powders was used: (1) 20 wt. % of underseparated titanium powder containing 2.0% chlorine and 0.8% of magnesium and having particle size <100 μm, and (2) 80 wt. % of titanium hydride $TiH_2$ powder containing 3.9 wt. % of hydrogen, particle size <100 microns.

These powders are blended for 6 hours, and the obtained mixed powder was compacted at 400 MPa to a low density green compact of 3.18 g/cm$^3$.

The green compact having a thickness 20 mm was heated to 250° C. at a slow heating rate of ~7° C./min and held at this temperature for 70 min to release absorbed water from titanium powder. Then, the net-shaped green compacts were exposed to a temperature of 350° C. for 60 min during heating in vacuum furnace for evacuation of chlorine and magnesium from the material.

Further, heating was continued at the heating rate of ~16° C./min to 400-420° C. in the atmosphere of emitted hydrogen and held at this temperature for 30 min to form β-phase titanium and release reaction water from the powder.

Almost complete reduction of surface oxides of green compact particles by emitted atomic hydrogen was carried out by further heating the green compact to 600-610° C. and holding at this temperature for 45 min when the green compact still had open porosity structure. At the same time, β-phase titanium was transformed to α-phase titanium.

Further, the diffusion-controlled chemical homogenization was carried out by heating of green compact to 800-820° C. with a heating rate of 6-7° C./min and holding at this temperature for 30 min that was resulted in densification of green compact to 4.42 g/cm$^3$ due to complete dehydrogenation and active shrinkage of compact containing both titanium and hydrogenated titanium components.

Then, heating of the cleaned and refined green compact was continued in vacuum of $10^{-4}$ Torr at the rate of 5-10° C./min to the temperature 1350° C. followed by holding at this temperature for 2 hours to form a sintered dense compact, and finally, cooling the sintered compact was done to obtain a flat titanium plate.

The titanium plate was hot rolled to the thickness of 15 mm followed by vacuum annealing at 750° C. for 3 hours.

Measured contents of impurities in the final product were the following:

oxygen <0.16 wt. %,
hydrogen <0.005 wt. %,
chlorine <0.0015 wt. %,
magnesium <0.0048 wt. %,
sodium <10 ppm.

Standard specimens for mechanical testing were cut and machined from the titanium plate. Mechanical properties of the manufactured titanium plate were: ultimate tensile strength 558-575 MPa, yield strength 461-494 MPa, and elongation at break 21-23%. Due to low content of contaminants, the resulting titanium plate is weldable using both GTAW and GMAW arc welding technique.

Example 5

A powder blend of three types of base powders were used: (1) Crushed hydrogenated titanium sponge TG-110 grade of Zaporozhye Titanium & Magnesium Corp., Ukraine, (2) Titanium hydride $TiH_2$ powder produced by a new "Non-Kroll" process combining reduction and distillation (ADMA hydrogenated powder), and (3) CP titanium powder manufactured by dehydration of $TiH_2$. All powders had particle size <100 microns, at the average particle size of 40 microns. Titanium hydride powder contained 3.5% of hydrogen.

These powders were mixed together at the weight ratio of hydrogenated titanium powder (crushed hydrogenated titanium sponge and titanium hydride) to CP titanium of 90% to 10%.

The obtained mixed powder was compacted at 640 MPa to a low density green compact of 3.15 g/cm$^3$, which is significantly less than that of compacts produced only from CP titanium powder.

The green compact having the thickness 18 mm was heated to 250° C. at a slow heating rate of ~7° C./min and held at this temperature for 60 min to release absorbed water from the powder. Then, heating was continued at the heating rate of ~17° C./min to 550-570° C. in the atmosphere of emitted hydrogen and held at this temperature for 30 min to form β-phase titanium and release reaction water from the powder.

Almost complete reduction of surface oxides of the powder by emitted atomic hydrogen was carried out by further heating the green compact to 650° C. and holding at this temperature for 60 min when the green compact still had open porosity structure. At the same time, β-phase titanium was transformed to α-phase titanium.

Further, the diffusion-controlled chemical homogenization was carried out by heating of green compact to 840° C. with the rate of 7° C./min and holding at this temperature for 30 min that resulted in densification of the green compact to 4.43 g/cm$^3$ due to complete dehydrogenation and active shrinkage of the compact containing both CP titanium powder and hydrogenated titanium component.

Then, heating of the cleaned and refined green compact was continued in vacuum of $10^{-4}$ Torr at the rate of 5-10° C./min to the temperature 1250° C. followed by holding at this temperature for 4 hours form a sintered dense compact, and finally, cooling the sintered compact was done to obtain a flat titanium plate.

The titanium plate was hot rolled to the thickness of 12 mm followed by vacuum annealing at 750° C. for 2 hours.

Measured contents of impurities in the final product were the following:
oxygen 0.158 wt. %,
hydrogen 0.0054 wt. %,
chlorine <0.001 wt. %,
magnesium 0.004 wt. %,
sodium <10 ppm.

Standard specimens for mechanical testing were cut and machined from the titanium plate. Mechanical properties of the manufactured titanium plate were: ultimate tensile strength 544-580 MPa, yield strength 449-467 MPa, and elongation at break 20-21%.

Example 6

A powder blend of four types of powder was used: (1) 20 wt. % of underseparated titanium powder containing 2.0% chlorine and 0.8% of magnesium and having particle size <100 μm, (2) 20 wt. % of underseparated and hydrogenated titanium powder containing 2% of hydrogen, (3) 20 wt. % of C.P. titanium powder, (4) 30 wt. % of titanium hydride $TiH_2$ powder containing 3.4% of hydrogen, particle size <100 microns, and (5) 10 wt. % of the 60Al-40V master alloy powder having particle size <65 μm.

These powders are blended for 6 hours, and the obtained mixed powder was compacted at 800 MPa to a low density green compact of 3.51 g/cm$^3$.

The green compact having a thickness of 20 mm was heated to 250° C. at slow heating rate ~7° C./min and held at this temperature for 70 min to release absorbed water from the powder. Then, net-shaped green compacts were exposed at 350° C. for 60 min during heating in vacuum furnace for evacuation of chlorine and magnesium from the material.

Further, heating was continued at the heating rate of ~16° C./min to 500-520° C. in the atmosphere of emitted hydrogen and held at this temperature for 30 min to form β-phase titanium and release reaction water from the powder.

Almost complete reduction of surface oxides of green compact particles by emitted atomic hydrogen was carried out by further heating the green compact to 630-650° C. and holding at this temperature for 40 min when the green compact still had open porosity structure. At the same time, β-phase titanium was transformed to α-phase titanium.

Further, the diffusion-controlled chemical homogenization was carried out by heating of green compact to 820-840° C. with the rate of 6-7° C./min and holding at this temperature for 30 min that was resulted in densification of green compact to 4.44 g/cm$^3$ due to complete dehydrogenation and active shrinkage of compact containing both titanium and hydrogenated titanium components.

Then, heating of the cleaned and refined green compact was continued in vacuum of $10^{-4}$ Torr at the rate of 5-10° C./min to a temperature of 1300° C. followed by holding at this temperature for 2 hours to form a sintered dense compact, and finally, cooling the sintered compact was done to obtain a flat titanium plate.

The titanium plate was hot rolled to the thickness of 15 mm followed by vacuum annealing at 750° C. for 3 hours.

Measured contents of impurities in the final product were the following:
oxygen <0.15 wt. %,
hydrogen <0.005 wt. %,
chlorine <0.0015 wt. %,
magnesium <0.0044 wt. %,
sodium <10 ppm.

Standard specimens for mechanical testing were cut and machined from the titanium plate. Mechanical properties of the manufactured titanium plate were: ultimate tensile strength 968-1033 MPa, yield strength 881-904 MPa, and elongation at break 15-17%.

Example 7

Approximately 200 articles of various shapes were produced by the following process. A powder blend of titanium hydride powder (ADMATAL™ from ADMA Products, Inc.), in an amount sufficient to provide 90% by weight of Ti, and master alloy powder (60% Al-40% V) in an amount sufficient to provide 10% by weight of master alloy was blended together to achieve an alloy having a stoichiometry of Ti-6Al-4V (90% Ti, 6% Al, and 4% V). The resulting mixture was prepared and processed by die pressing using the following parameters: ramp speed—0.15-0.02 IPS; compacting pressure 40-50 tsi (551-690 MPa); compression dwell time—1-15 sec.; green density 70-86%; to form a green pre-form. The composition of the titanium hydride powder is given in Table 1 below:

TABLE 1

| Material | Fe | Cl | N | C | Si | Ni | O | H | Ti |
|---|---|---|---|---|---|---|---|---|---|
| $TiH_2$ Powder | 0.070 | 0.060 | 0.030 | 0.010 | 0.010 | 0.030 | 0.100 | 3.35 | Bal |

The articles were divided into two groups, and processed differently. In one group (Lot 1), the green pre-form was dehydrogenated and partially sintered according to an embodiment of the invention, using a heating RAMP of 3-20 C/min, and a temperature of dehydrogenation of 750 C-850 C. The dehydrogenated and partially sintered articles were then sized, using a ramp speed—0.15-0.02 IPS; sizing pressure 45-55 tsi (551-690 MPa); compression dwell Time—1-15 sec.; and green density >92%, and then subjected to high temperature vacuum sintering to finally densify the article using a heating RAMP of 3-20 C/min; a temperature of sintering of 1200° C. over 4 hours, and obtaining a sintered density of 0.155 lbs/inch$^3$. The resulting articles were then subjected to post-processing, including hot isostatic pressing (HIP), grinding, and tumbling.

In the other group of articles (Lot 2), the green pre-form was dehydrogenated and partially sintered according to an embodiment of the invention using the same parameters as for Lot 1. The dehydrogenated and partially sintered articles were then sized, also using the same parameters as for Lot 1, and then subjected to high temperature vacuum sintering to finally densify the article using a heating RAMP of 3-20° C./min; a temperature of sintering of 1315° C. for 4 hours, and obtaining a sintered density of 0.157 lbs/inch$^3$. The resulting articles were then subjected to post-processing, including hot isostatic pressing (HIP), grinding, and tumbling.

The various parts were evaluated for oxygen and hydrogen contents, density, and microstructure before and after being subjected to HIP.

Figure 6A:
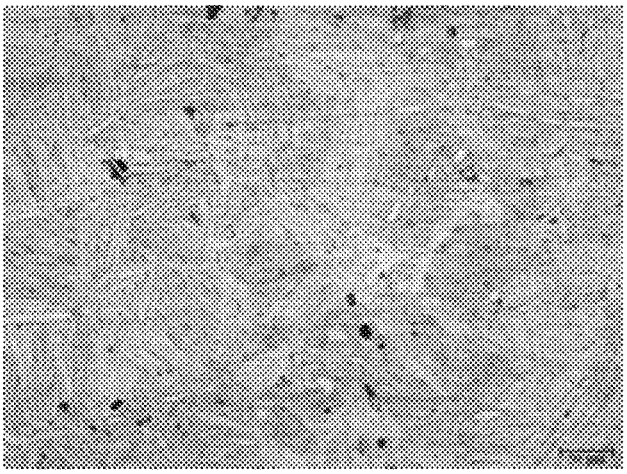
FIGS. 6*a* and 6*b* are micrographs showing the microstructure of a titanium alloy article prepared according to an embodiment of the invention.
Figure 6B:
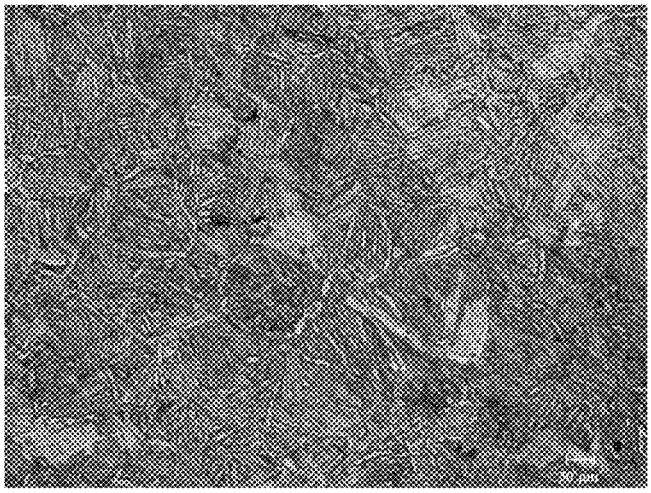

The microstructure of the articles prepared according to the procedure described above for Lot 1 is shown in FIG. 6A before HIP, and in FIG. 6B after HIP. Additionally, articles were prepared as test specimens for ASTM test E8-13, i.e., as standard 0.500 inch Round Tension Test Specimens with 2 inch Gauge Length, machined from the Ti-6Al-4V alloy articles produced as described above. The Lot 1 specimens were tested for oxygen content, hydrogen content, and density are given in Table 2 below.

TABLE 2

| | Density, lbs/inch$^3$ | | | |
|---|---|---|---|---|
| Ti-6A1-4V | Vacuum Sintering | Vacuum Sintering/HIP | Oxygen, wt. % | Hydrogen, ppm |
| Lot # 1 | 0.155 | 0.160 | 0.28 | <10 |

The results of testing the Lot 1 specimens for tensile strength, yield strength, elongation, and reduction in area are given below in Table 3 below.

TABLE 3

| | Tensile Test | | |
|---|---|---|---|
| | S-141029-059-1 | S-141029-060-1 | S-141029-061-1 |
| Tensile Strength (PSI) | 146,000 | 147,000 | 147,000 |
| Yield Strength 0.2% Offset (PSI) | 129,000 | 131,000 | 129,000 |
| Elongation in 4D (%) | 16 | 16 | 17 |
| Reduction of Area (%) | 36 | 28 | 36 |
| Test Direction | Longitudinal | Longitudinal | Longitudinal |
| Test Method | ASTM E8-13a | ASTM E8-13a | ASTM E8-13a |

Figure 7A:
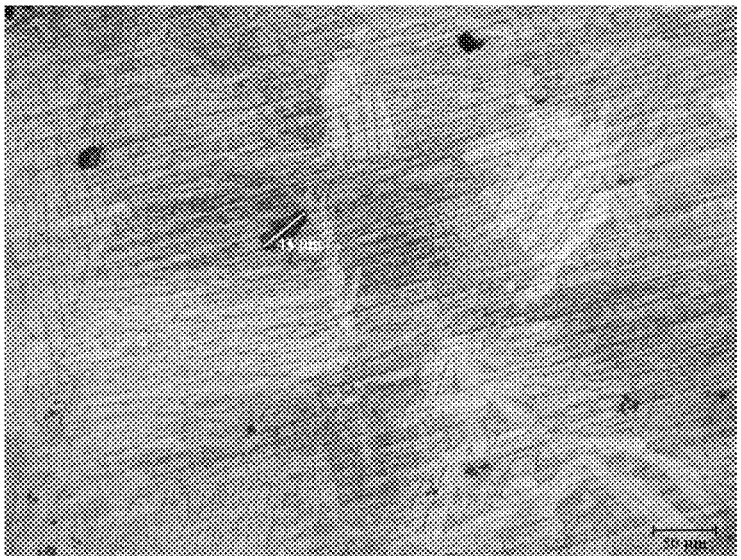
FIGS. 7*a* and 7*b* are micrographs showing the microstructure of a titanium alloy article prepared according to another embodiment of the invention.
Figure 7B:
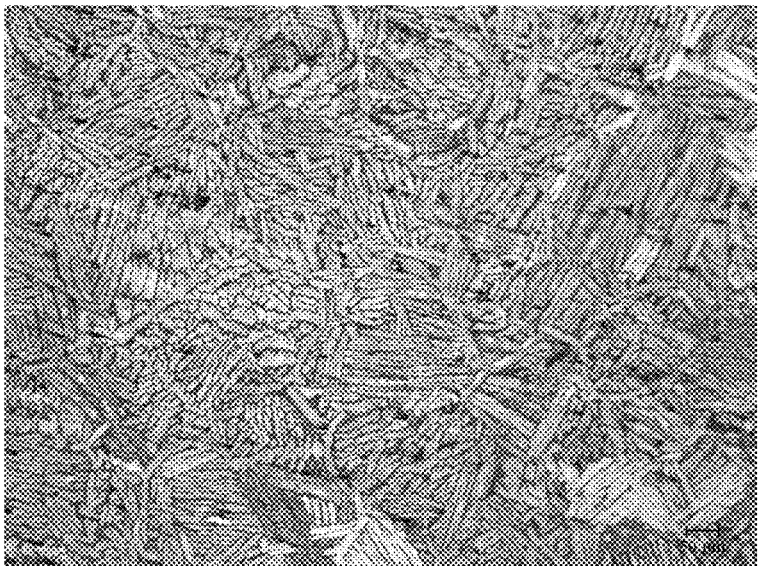

The microstructure of the articles prepared according to the procedure described above for Lot 2 is shown in FIG. 7A before HIP, and in FIG. 7B after HIP. Additionally, articles were prepared as test specimens for ASTM test E8-13, i.e., as standard 0.500 inch Round Tension Test Specimens with 2 inch Gauge Length, machined from the Ti-6Al-4V alloy articles produced as described above. The Lot 2 specimens were tested for oxygen content, hydrogen content, and density are given in Table 4 below.

TABLE 4

| | Density, lbs/inch$^3$ | | | |
|---|---|---|---|---|
| Ti-6A1-4V | Vacuum Sintering | Vacuum Sintering/HIP | Oxygen, wt. % | Hydrogen, ppm |
| Lot # 2 | 0.157 | 0.160 | 0.28 | <10 |

The results of testing the Lot 2 specimens for tensile strength, yield strength, elongation, and reduction in area are given below in Table 5 below.

TABLE 5

| | Tensile Test | | |
|---|---|---|---|
| | S-141029-062-1 | S-141029-063-1 | S-141029-064-1 |
| Tensile Strength (PSI) | 147,000 | 147,000 | 146,000 |
| Yield Strength 0.2% Offset (PSI) | 130,000 | 128,000 | 128,000 |
| Elongation in 4D (%) | 17 | 16 | 16 |
| Reduction of Area (%) | 33 | 33 | 33 |
| Test Direction | Longitudinal | Longitudinal | Longitudinal |
| Test Method | ASTM E3-13a | ASTM E8-13a | ASTM E8-13a |

The chemical composition of the finished parts prepared according to the methods described above is provided in Table 6 below.

TABLE 6

| Tests | Results/Units | Method |
|---|---|---|
| Al | 5.86% | Optical Emission Spectroscopy |
| C | 0.0064% | Leco Furnace |
| Cl | 0.0061% | Pyrohydrolysis followed by Ion Chromatography |
| Fe | 0.15% | Optical Emission Spectroscopy |
| H | 0.0005% | Leco Furnace |
| Mg | 0.002% | ICP-MS |
| N | 0.026% | Leco Furnace |
| Na | <0.005% | ICP-MS |
| O | 0.29% | Leco Furnace |
| Others Each | <0.05% | Optical Emission Spectroscopy |
| Others Total | <0.15% | Optical Emission Spectroscopy |
| Si | 0.011% | Optical Emission Spectroscopy |
| V | 4.00% | Optical Emission Spectroscopy |
| Y | <0.002% | Optical Emission Spectroscopy |

The invention have been thus explained and described by reference to certain specific embodiments and examples, it will be appreciated that these specific embodiments and examples are illustrative, rather than limiting of the appended claims.

What is claimed is:

1. A method for the manufacture of near-net shape titanium or titanium alloy articles from metal powders comprising:

(a) providing a powder blend comprising (1) one or more hydrogenated titanium powders containing around 0.2 to around 3.4 weight % of hydrogen, and (2) one or more master alloys, comprising Al, V, or a combination thereof, (b) consolidating the powder blend by compacting the powder blend to provide a green compact, (c) heating the green compact to a temperature ranging from around 400° C. to around 900° C., thereby releasing the majority or all of the hydrogen from the hydrogenated titanium, and partially sintering the green compact without fully sintering it, to obtain a partially sintered article having a density of about 60% to about 85% of theoretical density, (d) sizing the partially sintered article at a temperature at or around room temperature to obtain an sized article having a density of about 80% to about 95% of theoretical density, (e) heating the sized article in vacuum thereby sintering the article to form a sintered dense compact having a density of 99% of theoretical density or higher.

2. The method according to claim 1, wherein the sized article exhibits a linear shrinkage of 3% or less during step (e).

3. The method according to claim 1, further comprising subjecting the article obtained from step (e) to (f) hot processing selected from the group consisting of forging, rolling, hot isostatic pressing (HIP), extrusion, and combinations of these.

4. The method according to claim 3, further comprising subjecting the article obtained from step (e) to (g) grinding, or (h) tumbling, or both.

5. The method according to claim 1, wherein the consolidating of the green compact comprises molding of the powder blend.

6. The method according to claim 1, wherein the step (c) results in a material wherein all or most of the hydrogen is emitted, and full sintering of the material has not occurred.

7. The method according to claim 1, wherein the step (c) results in a soft material having a soft titanium matrix within which is evenly distributed a master alloy.

8. The method according to claim 7, wherein the master alloy comprises about 60% Al and about 40% V.

9. The method according to claim 8, wherein the master alloy is present in the titanium matrix in a concentration of about 10%.

10. The method according to claim 1, wherein the step (e) provides a linear shrinkage of about 3% or less.

11. The method according to claim 1, wherein the hydrogenated titanium powder, the master alloy powder, or both, have an average particle size less than about 150 microns.

12. The method according to claim 11, wherein the hydrogenated titanium powder, the master alloy powder, or both, have an average particle size greater than 100 microns.

13. The method according to claim 1, wherein the partially sintered article has an average grain size between about 100 microns and about 150 microns.

14. A near net shape titanium alloy article produced by the process according to claim 1.

* * * * *